United States Patent [19]

Spring

[11] 4,303,179

[45] Dec. 1, 1981

[54] HIGH DENSITY CAN STACK FOR AUTOMATIC CAN VENDERS

[75] Inventor: Carl E. Spring, La Crosse, Wis.

[73] Assignee: La Crosse Cooler Company, La Crosse, Wis.

[21] Appl. No.: 109,443

[22] Filed: Jan. 4, 1980

[51] Int. Cl.[3] ..... G07F 11/12

[52] U.S. Cl. ..... 221/7; 221/109

[58] Field of Search ..... 221/109, 15, 125, 129, 221/110, 112, 114, 116, 298, 108, 7

[56] References Cited

U.S. PATENT DOCUMENTS 2,644,735 7/1953 James ..... 221/118 X
2,877,928 3/1959 Patzer et al. ..... 221/109 X
3,348,733 10/1967 Johnson ..... 221/298
3,831,806 8/1974 Lindsey ..... 221/129 X

*Primary Examiner*—Stanley H. Tollberg
*Attorney, Agent, or Firm*—Wheeler, House, Fuller & Hohenfeldt

[57] ABSTRACT

A coin operated vending machine has a plurality of storage racks for containers, with each storage rack provided with a selector control button. Each rack includes first and second storage sections, each section having slant storage shelves and a discharge channel. The discharge channels for each section discharge to a common outlet. A circuit alternates discharge in a pre-selected sequence from the two sections in each rack to rotate the stock and insure that the first cans loaded are the first cans vended.

5 Claims, 3 Drawing Figures

HIGH DENSITY CAN STACK FOR AUTOMATIC CAN VENDERS

BACKGROUND OF THE INVENTION

The invention relates to coin actuated can vending machines in which cans are stored on slanting shelves which have gate controlled outlets for discharge into a vertical discharge channel which delivers the cans to a discharge chute or ramp. Systems of this type have been in use for many years, including systems which employ serpentine channels to maximize storage capacity. U.S. Pat. No. 2,956,660 is illustrative of a serpentine channel. The prior art also includes dual serpentine channels nested together to increase storage capacity and which have separate vend mechanisms operated by separate control buttons.

Because of a desire to vend only fresh products and the interest in vending fresh stock, it is desirable to have a vending system in which the first cans loaded in the machine are also the first cans to be vended.

SUMMARY OF THE INVENTION

The invention provides a storage system with a plurality of storage racks, with each rack operated with a single beverage selection button. Each rack contains two storage sections and each section has a separate delivery channel. The single section button for both sections actuates control means to control the vend mechanisms so that a selected quantity of cans will be discharged from one section and then the system is switched so that a selected quantity of cans will be delivered from the second section before the first section is again enabled to discharge cans. This sequencing insures that cans of both sections are vended although the first section may have been refilled by the attendant with fresh stock. In one embodiment, the "sold out" switch for the first section can provide the signal to enable the vend mechanism for the second storage section. Alternatively, programmable means with a memory containing information regarding a preselected quantity of cans will disable the vend gate for the first storage section and enable the vend gate of the second section after a preselected quantity of cans has been discharged from the first storage section. After a preselected quantity of cans has been discharged from the second section, the vend mechanism for the second section is disabled and the first section vend mechanism is again enabled.

If separate control buttons were provided for each section, random selection by the operators might not result in equal use of both sections.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
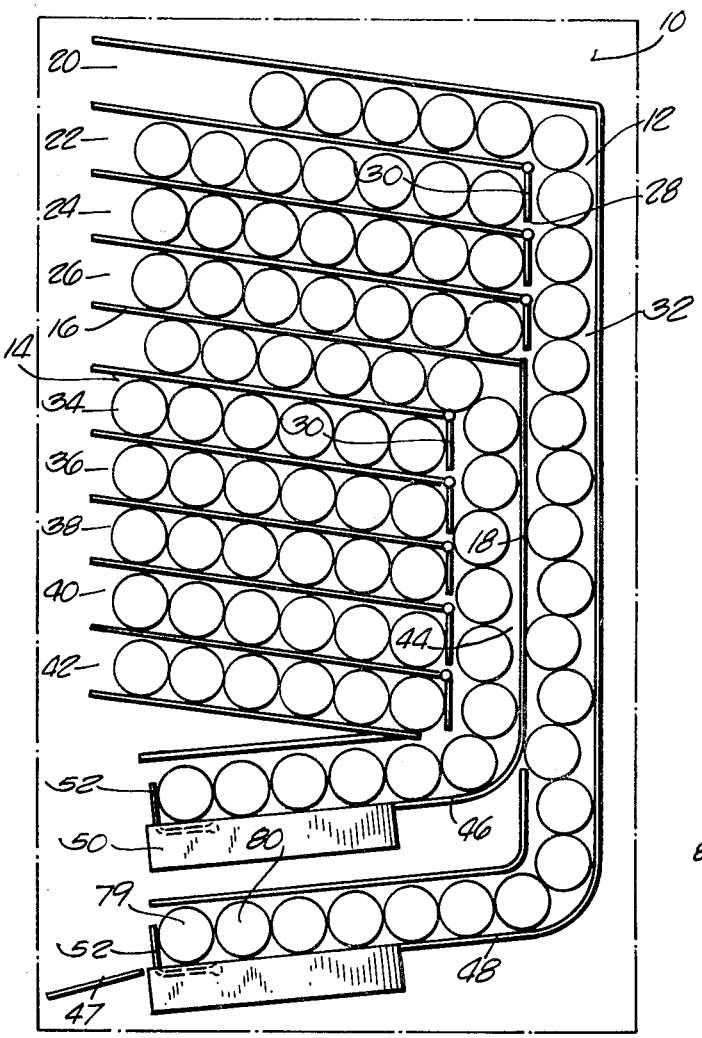
FIG. 1 is a diagrammatic side elevational view of a single rack in accordance with the invention.

In the drawings, FIG. 1 diagrammatically shows a beverage container rack 10 intended for use with a single beverage and which would be located in side by side relationship with four or more similar stacks operated by a separate select or control button. Inasmuch as the other racks are similar, only one of the five racks will be described in detail. The other racks would typically contain beverage of different flavors.

Each rack 10 includes a first storage section 12 and a second storage section 14. Storage section 12 is separated from 14 by slant shelf wall 16 and vertical channel wall 18. Slant shelf rows 20, 22, 24 and 26 are in the first storage section 12 and have outlets 28 controlled by gates 30, with the outlets communicating with a vertical discharge channel 32. Although FIG. 1 shows a single wall 18 between sections, each storage section, in practice, can be separately formed from wire rod and each section assembled together so that there may be dual runs of wire rod forming some of the common walls or partitions.

The second storage section 14 includes slant shelf storage rows 34, 36, 38, 40 and 42 also controlled by gates 30. The storage shelves or rows in the second section 14 communicate with a vertical discharge channel 44. The gates 30 prevent the containers held back thereby from discharge until cans are exhausted from the storage shelves above. As is apparent, when cans are located in the vertical channels adjacent a particular gate, the cans keep the gates from opening.

The vertical channel 44 has an angularly related discharge portion 46 and the channel 32 has an angularly related discharge portion 48 generally parallel to discharge channel 46. The discharge channels 46 and 48 are controlled by vend mechanisms 50 and 52 and can discharge onto a common ramp 47.

Figure 2:
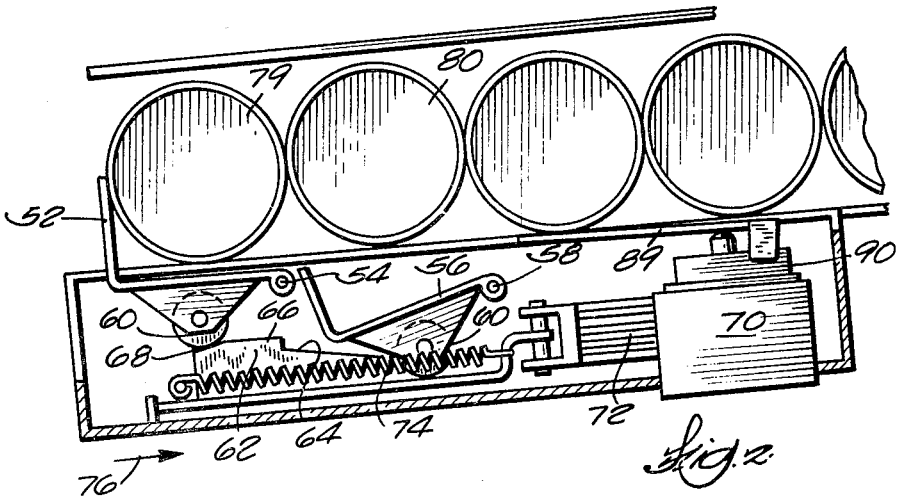
FIG. 2 is an enlarged sectional view of the vend mechanisms illustrated in FIG. 1.

The vend mechanisms 50 and 52 are identical and can be in accordance with the structure illustrated in FIG. 2, which is described and claimed in my copending patent application Ser. No. 097,270, filed Nov. 26, 1979, and include a leading can or foremost can gate 52 which is L-shaped and pivotally supported on a bracket by a pivot 54 and a row hold-back gate 56 having a pivot 58. Rollers 60 cooperate with a slide 62 having ramp or cam surfaces 64, 66 and 68. A solenoid 70 having an armature 72 is connected to the slide and a spring 74 urges the slot to the standby position shown in FIG. 2 in which the gate 52 blocks the foremost can 79 from discharge. When the solenoid 70 is energized, the slide is retracted in the direction shown by arrow 76 and the roller 60 falls off the end of the slide, lowering the gate 52 to release the can 79. The gate 56 moves into a blocking position on the can 80 to prevent release of any cans during vending of the can 79.

Figure 3:
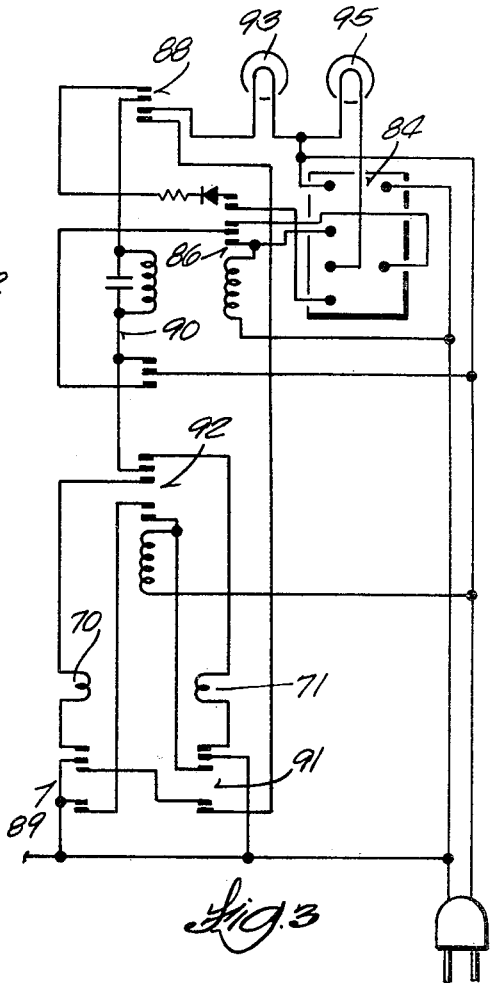
FIG. 3 is a schematic diagram of a control circuit to operate the vend mechanisms.

In accordance with the invention, control means are provided which are coupled to the vend mechanisms 50 and 52 to provide a delivery sequence in which a selected quantity of stored cans are released from the first section prior to release of any cans from the second storage section. As disclosed in FIG. 3, the circuit includes a coin actuated mechanism 84, a credit relay 86, a select switch 88, a vend relay 90, transfer relay 92 and a vend solenoid 70 for vend mechanism 52 and a vend solenoid 71 for vend mechanism 50. "Sold out" or paddle switches 89, 91 are respectively located in each of the discharge channels 46, 48. The circuit also includes conventional components such as a "sold out" light 93 and correct change light 95.

In operation, when the proper coin is deposited the credit relay 86 enables the vend relay 90. The selector switch or button 88 will then energize the vend relay 70 of vend mechanism 52 to release can 79 if the paddle switch 89 is depressed by the presence of a can. With the circuit illustrated in FIG. 3, the first section will vend until all cans have been vended from storage rows 20, 22, 24 and 26 and the channel 48 emptied. When the normally depressed paddle switch is released, the switch will change the state of the transfer relay 92 to enable the vend solenoid 71 for storage section 14 and disable the vend solenoid 70. Cans will continue to be vended from storage section 14 until section 14 is emptied and the paddle switch 90 is released. The switches 89, 91 can be used to provide pulses to a memory circuit or counter to alternately enable and disable the circuits when a selected quantity of cans, such as 40, have been vended from each storage section.

What is claimed is:

1. In a coin operated vending machine having a frame and a plurality of container storage racks supported on said frame and arranged in side by side relationship, the improvement wherein each of said racks have first and second independent storage sections and each section having an independent delivery channel which delivers containers to an outlet, said first section including a plurality of inclined slant storage shelves communicating with a generally vertical discharge channel and including gates for each of said shelves other than the top shelf, wherein said second section delivery channel is generally vertical and aligned in parallel relationship with said first channel and located forwardly thereof and said second section including a plurality of slant storage shelves below said first section slant shelves and feeding into said second section vertical channel and including gates for said slant shelves other than the uppermost slant shelf in said second section, and wherein said delivery channels have inclined discharge ramps extending beneath the slant shelves, vend mechanisms for each delivery channel, and control means including a common selector switch, an electrical circuit coupled to said vend mechanism of each channel to provide a delivery sequence in which a selected quantity of stored containers from said first storage section is delivered initially, and means in said circuit disabling said vend mechanism for said first section and enabling said vend mechanism for said second section until a selected quantity of containers is delivered from said second system before again enabling said vend mechanism of said first system to insure that the containers initially loaded into the vending machine are discharged prior to discharge of containers loaded at a later date so that the first containers loaded are the first containers discharged to maintain the freshness of the stock and wherein the zone between the uppermost slant shelf of the first section and the lowermost slant shelf of said second section is completely occupied by slant shelves to maximize the storage capacity of said vending machine.

2. In a coin operated vending machine having a frame and a plurality of container storage racks supported on said frame and arranged in side by side relationship, the improvement wherein each of said racks have first and second independent storage sections and each section having an independent delivery channel which delivers containers to an outlet, vend mechanisms for each delivery channel, and control means including a common selector switch, an electrical circuit coupled to said vend mechanism of each channel to provide a delivery sequence in which a selected quantity of stored containers from said first storage section is delivered initially, and means in said circuit disabling said vend mechanism for said first section and enabling said vend mechanism for said second section until a selected quantity of containers is delivered from said second system before again enabling said vend mechanism of said first system to insure that the containers initially loaded into the vending machine are discharged prior to discharge of containers loaded at a later date so that the first containers loaded are the first containers discharged to maintain the freshness of the stock and wherein each vend mechanism for each section includes a leading container gate to release the leading container and a row gate to hold back the row of containers and including means to operate the gates, and wherein said circuit enables and disables the gates as required to vend the first and second storage sections in sequence.

3. The improvement of claim 2 wherein said circuit includes a sensor which indicates the presence and absence of containers in said discharge channel or ramp.

4. The improvement of claim 3 wherein said circuit includes means to count the number of cans vended from each of said sections and enables and disables the respective vend mechanisms when the predetermined quantity of containers has been discharged from said storage sections.

5. In a coin operated vending machine having a frame and a plurality of container storage racks supported on said frame and arranged in side by side relationship, the improvement wherein each of said racks have first and second independent storage sections and each section having an independent delivery channel which delivers containers to an outlet, said first section including a plurality of inclined slant storage shelves communicating with a generally vertical first discharge channel and including gates for each of said shelves other than the top shelf, said second section delivery channel being generally vertical and aligned in parallel relationship with said first discharge channel and located forwardly thereof and said second section including a plurality of slant storage shelves below said first section slant shelves and feeding into said second section vertical channel and including gates for said slant shelves other than the uppermost slant shelf in said second section and wherein said delivery channels have inclined discharge ramps extending beneath the slant shelves, vend mechanisms for each delivery channel, and control means including a common selector switch for each rack, and an electrical circuit coupled to said vend mechanism of each channel to provide a selected delivery sequence.

* * * * *